US010544694B2

(12) United States Patent
Ozarslan et al.

(10) Patent No.: US 10,544,694 B2
(45) Date of Patent: Jan. 28, 2020

(54) COOLING POCKET FOR TURBOMACHINE NOZZLE

(71) Applicant: General Electric Company, Schenectady, NY (US)

(72) Inventors: Allison Ozarslan, Mauldin, SC (US); Randall Douglas Gill, Greenville, SC (US)

(73) Assignee: General Electric Company, Schenectady, NY (US)

( * ) Notice: Subject to any disclaimer, the term of this patent is extended or adjusted under 35 U.S.C. 154(b) by 296 days.

(21) Appl. No.: 15/376,763

(22) Filed: Dec. 13, 2016

(65) Prior Publication Data

US 2018/0163553 A1 Jun. 14, 2018

(51) Int. Cl.
*F01D 9/06* (2006.01)

(52) U.S. Cl.
CPC ..... *F01D 9/065* (2013.01)

(58) Field of Classification Search
CPC . F01D 9/06; F01D 9/065; F01D 25/14; F01D 25/24; F01D 25/26; F01D 5/189; F02C 3/04; F02C 7/18; F05D 2250/22; F05D 2240/81
See application file for complete search history.

(56) References Cited

U.S. PATENT DOCUMENTS 7,625,180 B1 * 12/2009 Liang ..... F01D 5/186 29/889.2
8,414,263 B1 * 4/2013 Liang ..... F01D 5/186 416/96 R
2010/0284800 A1 11/2010 Sewall et al.
2013/0315725 A1 * 11/2013 Uechi ..... F01D 5/189 415/208.1
2015/0285097 A1 * 10/2015 Spangler ..... F01D 25/12 415/116
2015/0345300 A1 * 12/2015 Weber ..... F01D 5/18 416/96 R
2016/0017718 A1 1/2016 Zhang et al.

FOREIGN PATENT DOCUMENTS

EP 2 977 555 A1 1/2016

OTHER PUBLICATIONS

Extended European Search Report and Opinion issued in connection with corresponding EP Application No. 17204097.4 dated May 17, 2018.

* cited by examiner

*Primary Examiner* — Peter J Bertheaud
*Assistant Examiner* — Dnyanesh G Kasture
(74) *Attorney, Agent, or Firm* — Charlotte C. Wilson; James W. Pemrick

(57) ABSTRACT

The present disclosure is directed to a nozzle for a turbomachine. The nozzle includes an inner side wall, an outer side wall radially spaced apart from the inner side wall, and an airfoil extending radially from the inner side wall to the outer side wall. The airfoil defines a cavity that extends radially through the nozzle. The cavity is at least partially defined by a cavity wall. The cavity wall at least partially defines a pocket in fluid communication with the cavity. A cooling passage is defined by one of the inner side wall or the outer side wall. The cooling passage is in fluid communication with the cavity via the pocket.

16 Claims, 7 Drawing Sheets

COOLING POCKET FOR TURBOMACHINE NOZZLE

FIELD

The present disclosure generally relates to turbomachines. More particularly, the present disclosure relates to nozzles for turbomachines.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section includes one or more turbine nozzles, which direct the flow of combustion gases onto one or more turbine rotor blades. The one or more turbine rotor blades, in turn, extract kinetic energy and/or thermal energy from the combustion gases, thereby driving the rotor shaft. In general, each turbine nozzle includes an inner side wall, an outer side wall, and one or more airfoils extending between the inner and the outer side walls. Since the inner and the outer side walls are in direct contact with the combustion gases, it may be necessary to cool the airfoils.

In certain configurations, cooling air is routed through one or more cavities extending through the airfoils. Typically, this cooling air is compressed air bled from compressor section. Bleeding air from the compressor section, however, reduces the volume of compressed air available for combustion, thereby reducing the efficiency of the gas turbine engine.

BRIEF DESCRIPTION

Aspects and advantages of the technology will be set forth in part in the following description, or may be obvious from the description, or may be learned through practice of the technology.

In one aspect, the present disclosure is directed to a nozzle for a turbomachine. The nozzle includes an inner side wall, an outer side wall radially spaced apart from the inner side wall, and an airfoil extending radially from the inner side wall to the outer side wall. The airfoil defines a cavity that extends radially through the nozzle. The cavity is at least partially defined by a cavity wall. The cavity wall at least partially defines a pocket in fluid communication with the cavity. A cooling passage is defined by one of the inner side wall or the outer side wall. The cooling passage is in fluid communication with the cavity via the pocket.

In another aspect, the present disclosure is directed to a gas turbine engine that includes a compressor section, a combustion section, and a turbine section having a plurality of nozzles. Each nozzle includes an inner side wall, an outer side wall radially spaced apart from the inner side wall, and an airfoil extending radially from the inner side wall to the outer side wall. The airfoil defines a cavity that extends radially through the nozzle. The cavity is at least partially defined by a cavity wall. The cavity wall at least partially defines a pocket in fluid communication with the cavity. A cooling passage is defined by one of the inner side wall or the outer side wall. The cooling passage is in fluid communication with the cavity via the pocket.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
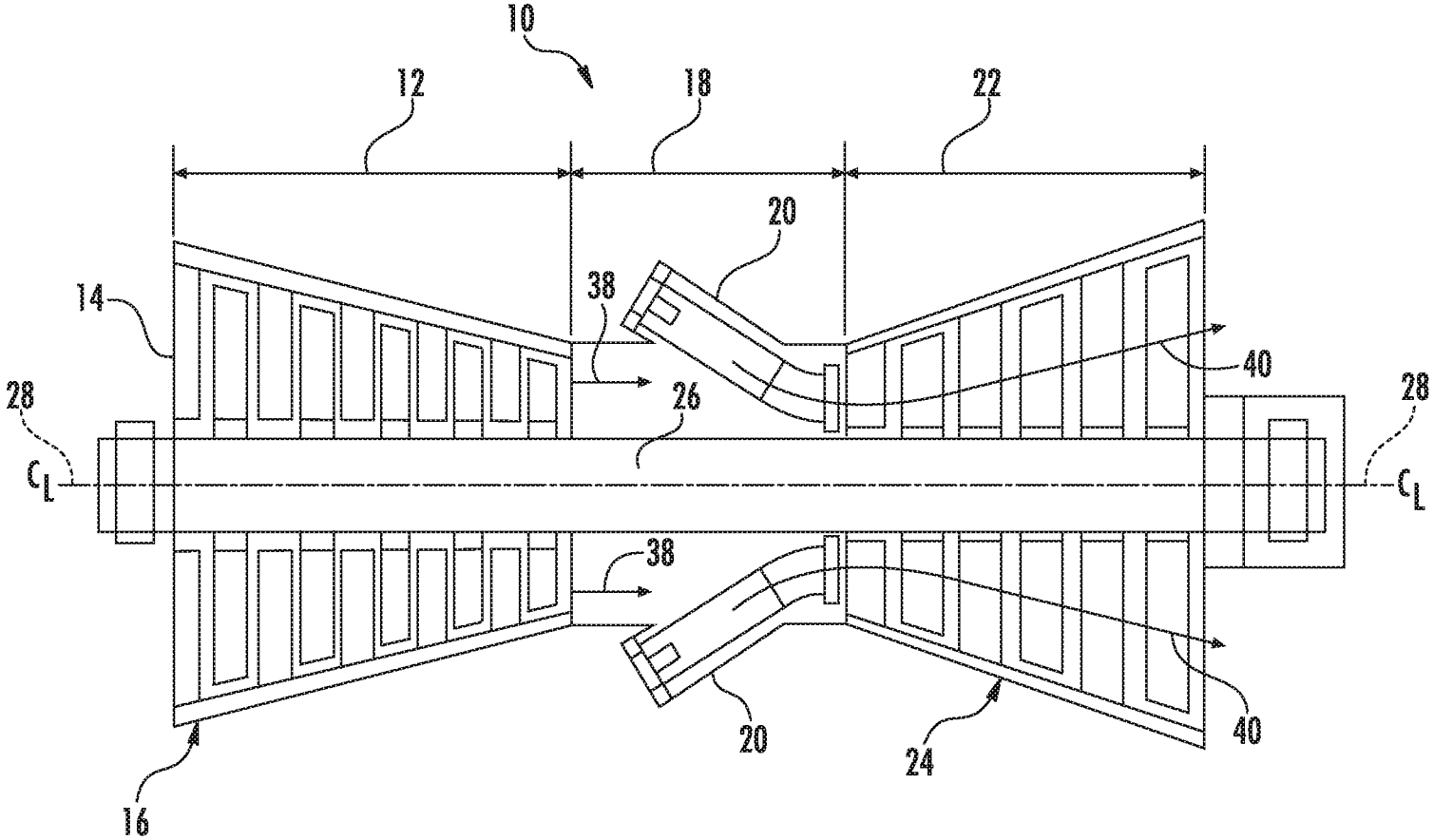
FIG. 1 is a schematic view of an exemplary gas turbine engine that may incorporate various embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, FIG. 1 is a schematic of an exemplary gas turbine engine 10 as may incorporate various embodiments disclosed herein. As shown, the gas turbine engine 10 generally includes a compressor section 12 having an inlet 14 disposed at an upstream end of an axial compressor 16. The gas turbine engine 10 further includes a combustion section 18 having one or more combustors 20 positioned downstream from the compressor 16. The gas turbine engine 10 also includes a turbine section 22 having a turbine 24 (e.g., an expansion turbine) disposed downstream from the combustion section 18. A shaft 26 extends axially through the compressor 16 and the turbine 24 along an axial centerline 28 of the gas turbine engine 10.

Figure 2:
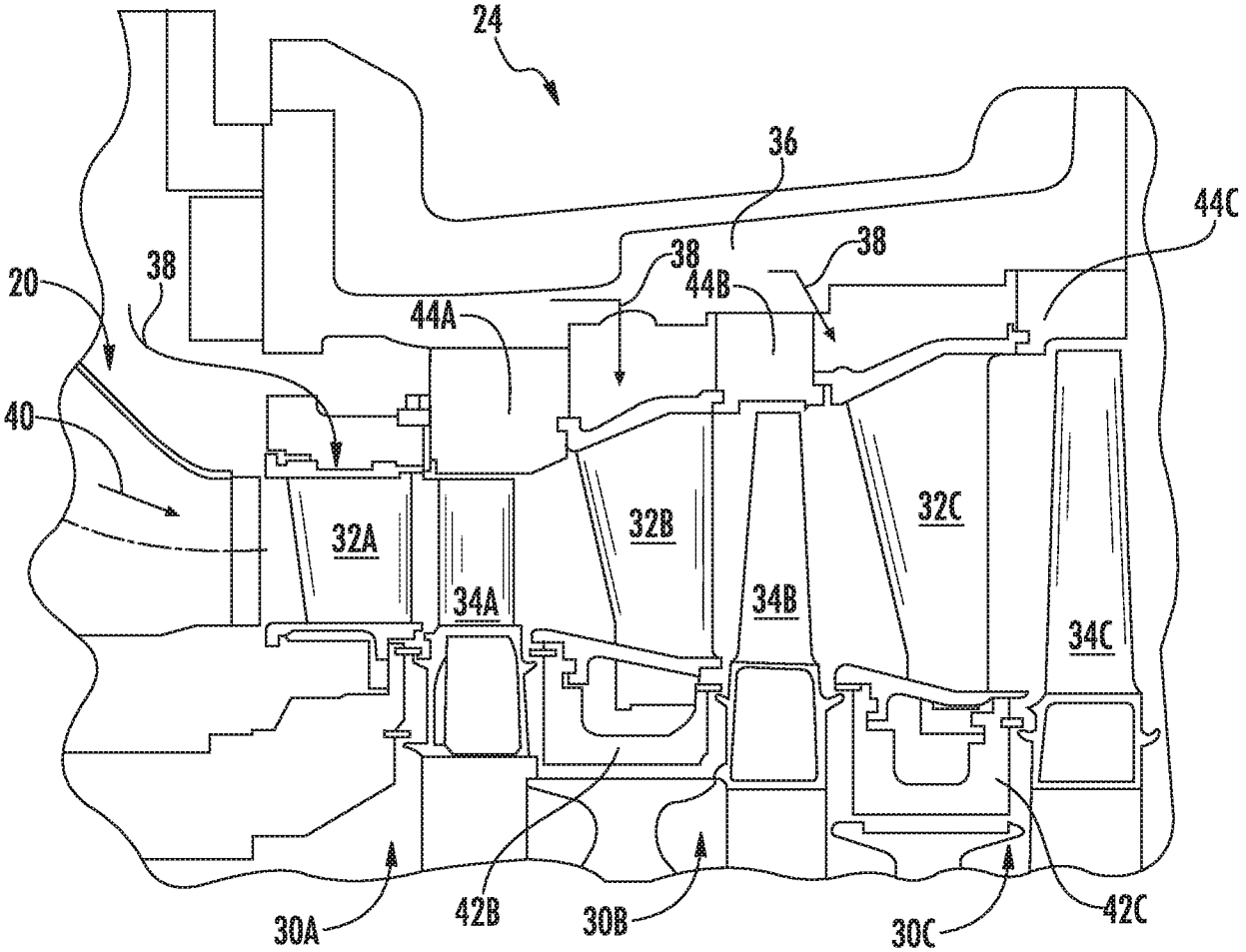
FIG. 2 is a cross-sectional view of an exemplary turbine section that may be incorporated in the gas turbine engine shown in FIG. 1 and may incorporate various embodiments disclosed herein.

FIG. 2 is a cross-sectional side view of the turbine 24, which may incorporate various embodiments disclosed herein. As shown in FIG. 2, the turbine 24 may include multiple turbine stages. For example, the turbine 24 may include a first stage 30A, a second stage 30B, and a third stage 30C. Alternately, the turbine 24 may include more or fewer turbine stages as are necessary or desired.

Each stage 30A-30C includes, in serial flow order, a corresponding row of turbine nozzles 32A, 32B, and 32C and a corresponding row of turbine rotor blades 34A, 34B, and 34C axially spaced apart along the rotor shaft 26 (FIG. 1). Each of the turbine nozzles 32A-32C remains stationary relative to the turbine rotor blades 34A-34C during operation of the gas turbine 10. Each of the rows of turbine nozzles 32B, 32C is respectively coupled to a corresponding diaphragm 42B, 42C. Although not shown in FIG. 2, the row of turbine nozzles 32A may also couple to a corresponding diaphragm. A first turbine shroud 44A, a second turbine shroud 44B, and a third turbine shroud 44C circumferentially enclose the corresponding row of turbine blades 34A-34C. A casing or shell 36 circumferentially surrounds each stage 30A-30C of the turbine nozzles 32A-32C and the turbine rotor blades 34A-34C.

As illustrated in FIGS. 1 and 2, the compressor 16 provides compressed air 38 to the combustors 20. The compressed air 38 mixes with fuel (e.g., natural gas) in the combustors 20 and burns to create combustion gases 40, which flow into the turbine 24. The turbine nozzles 32A-32C and turbine rotor blades 34A-34C extract kinetic and/or thermal energy from the combustion gases 40. This energy extraction drives the rotor shaft 26. The combustion gases 40 then exit the turbine 24 and the gas turbine engine 10. As will be discussed in greater detail below, a portion of the compressed air 38 may be used as a cooling medium for cooling the various components of the turbine 24 including, inter alia, the turbine nozzles 32A-32C.

Figure 3:
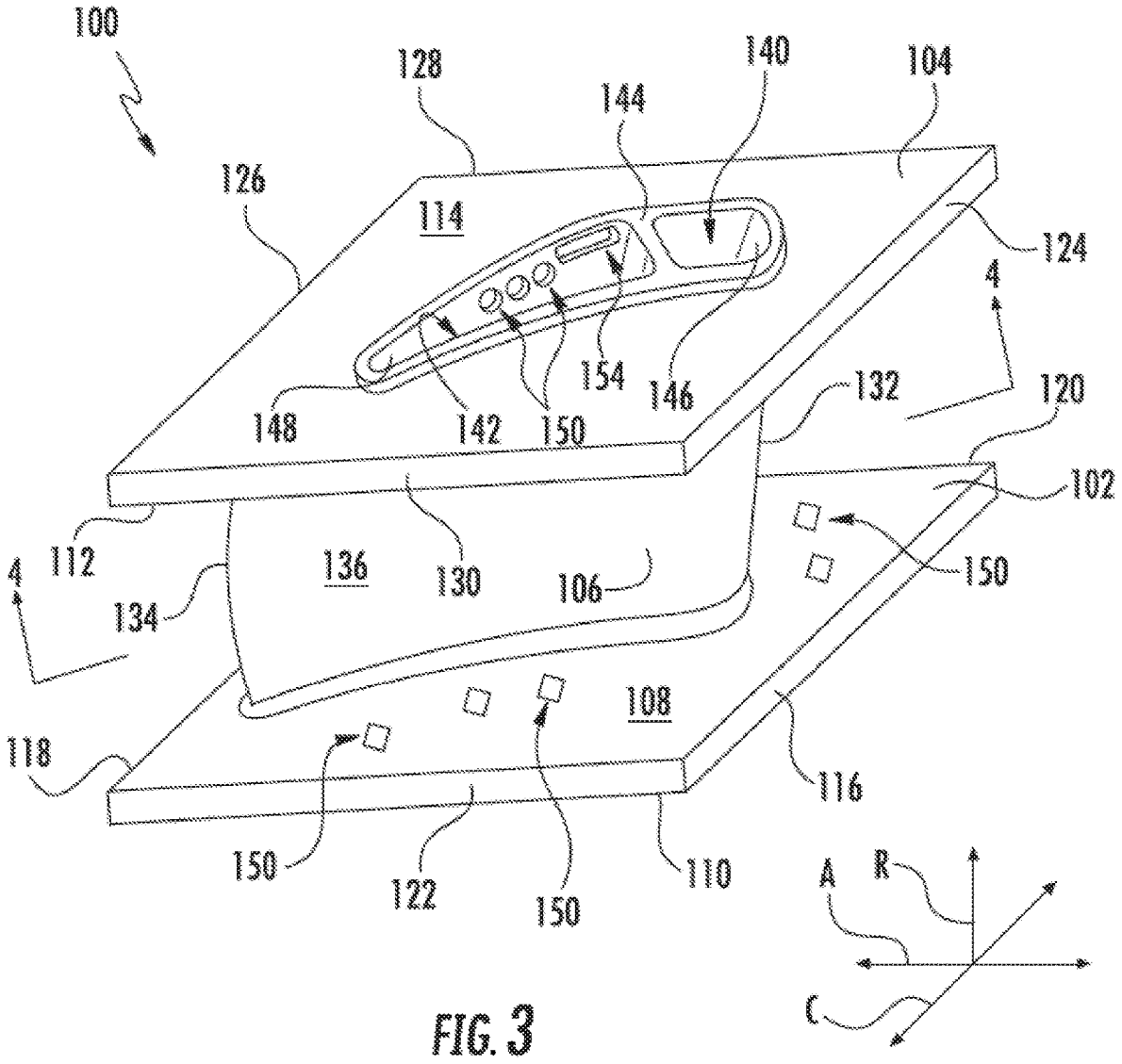
FIG. 3 is a perspective view of a turbine nozzle that may be incorporated into the turbine section shown in FIG. 2 and may incorporate various embodiments disclosed herein.

FIG. 3 is a perspective view of a turbine nozzle 100, which may be incorporated into the gas turbine engine 10 in place of or in addition to one or more of the turbine nozzles 32A-32C shown in FIG. 2. As shown, the turbine nozzle 100 defines an axial direction A, a radial direction R, and a circumferential direction C. In general, the axial direction A extends parallel to the axial centerline 28, the radial direction R extends orthogonally outward from the axial centerline 28, and the circumferential direction C extends concentrically around the axial centerline 28.

Referring particularly to FIG. 3, the turbine nozzle 100 includes an inner side wall 102 and an outer side wall 104 radially spaced apart from the inner side wall 102. An airfoil 106 extends in span from the inner side wall 102 to the outer side wall 104. In this respect, the turbine nozzle 100 illustrated in FIG. 3 is referred to in industry as a singlet. Nevertheless, the turbine nozzle 100 may have two airfoils 106 (i.e., a doublet), three airfoils 106 (i.e., a triplet), or more airfoils 106.

The inner and the outer side walls 102, 104 include various surfaces. More specifically, the inner side wall 102 includes a radially outer surface 108 and a radially inner surface 110 positioned radially inwardly from the radially outer surface 108. Similarly, the outer side wall 104 includes a radially inner surface 112 and a radially outer surface 114 oriented radially outwardly from the radially inner surface 112. As shown in FIGS. 2 and 3, the radially outer surface 108 of the inner side wall 102 and the radially inner surface 112 of the outer side wall 104 respectively define the inner and outer radial flow boundaries for the combustion gases 40 flowing through the turbine 24. The inner side wall 102 also includes a forward surface 116 and an aft surface 118 axially spaced apart and positioned downstream from the forward surface 116. The inner side wall 102 further includes a first circumferential surface 120 and a second circumferential surface 122 circumferentially spaced apart from the first circumferential surface 120. Similarly, the outer side wall 104 includes a forward surface 124 and an aft surface 126 axially spaced apart and positioned downstream from the forward surface 124. The outer side wall 104 also includes a first circumferential surface 128 and a second circumferential surface 130 spaced apart from the first circumferential surface 130. The inner and the outer side walls 102, 104 are preferably constructed from a nickel-based superalloy or another suitable material capable of withstanding the combustion gases 40.

Figure 4:
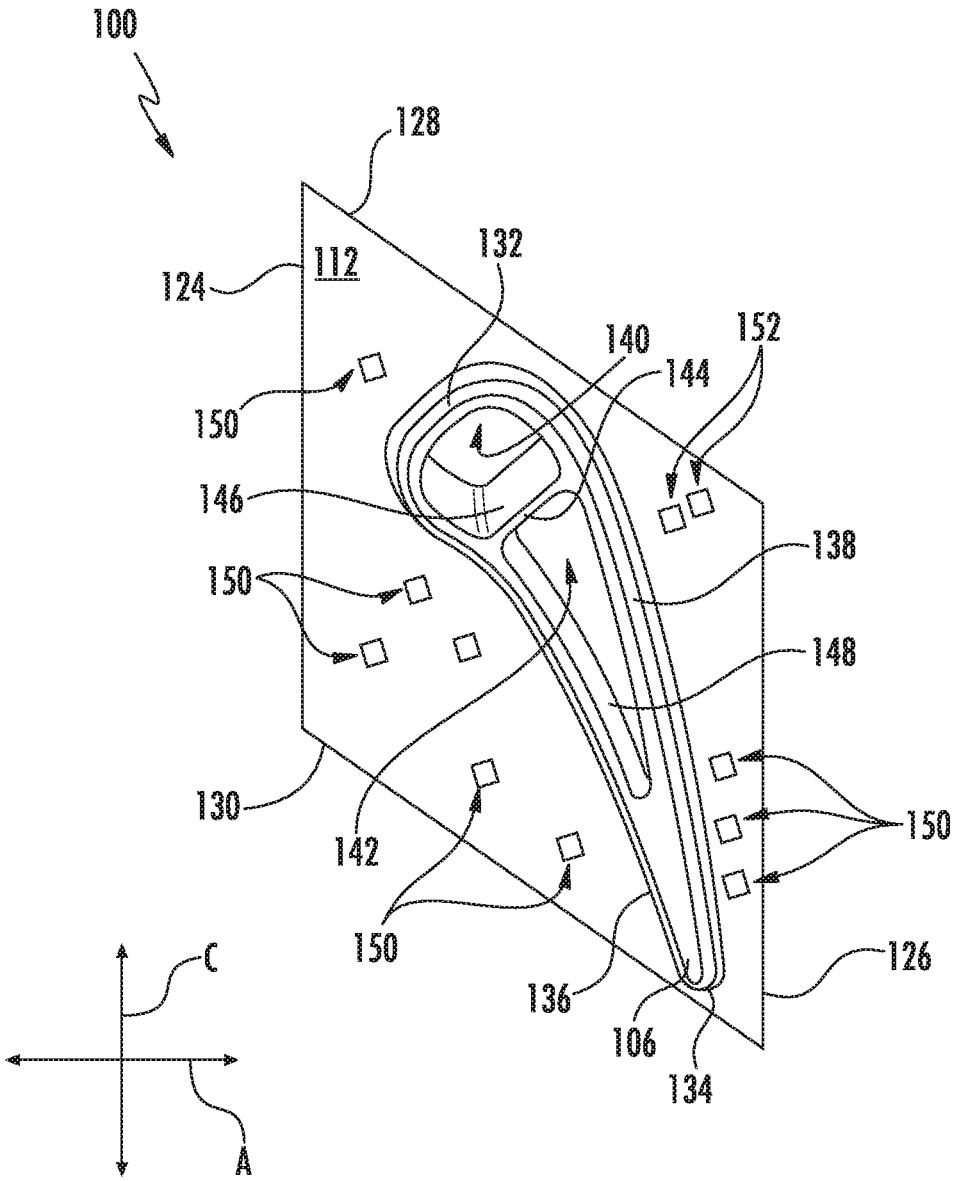
FIG. 4 is a cross-sectional view of the turbine nozzle taken generally about line 4-4 in FIG. 3, illustrating a plurality of cooling passages.

As mentioned above, the airfoil 106 extends from the inner side wall 102 to the outer side wall 104. As illustrated in FIGS. 3 and 4, the airfoil 106 includes a leading edge 132 disposed proximate to the forward surfaces 116, 124 of the inner and the outer side walls 102, 104. The airfoil 106 also includes a trailing edge 134 disposed proximate to the aft surfaces 118, 126 of the inner and the outer side walls 102, 104. Furthermore, the airfoil 106 includes a pressure side wall 136 and an opposing suction side wall 138 (FIG. 4) extending from the leading edge 132 to the trailing edge 134. The airfoil 106 is preferably constructed from a nickel-based superalloy or another suitable material capable of withstanding the combustion gases 40.

The airfoil 106 may define one or more cavities therein. In the embodiment illustrated in FIGS. 3 and 4, the airfoil 106 defines a forward cavity 140 and an aft cavity 142. In certain embodiments, an insert (not shown) may be positioned in each of the cavities 140, 142. A rib 144 may separate the forward and the aft cavities 140, 142. A forward cavity wall 146 and an aft cavity wall 148 respectively demarcate the outer boundaries of the forward and the aft cavities 140, 142. In this respect, the cavity walls 146, 148 at least partially define the cavities 140, 142. In alternate embodiments, the airfoil 106 may define one cavity, three inner cavities, or four or more cavities. As shown, the cavities 140, 142 extend radially through the turbine nozzle 100. That is, the cavities 140, 142 extend radially through the inner side wall 102, the airfoil 106, and the outer side wall 108. In this respect, a portion of the compressed air 38 (FIG. 2) may flow through the cavities 140, 142 or any inserts positioned therein to cool the inner side wall 102, the airfoil 106, and/or the outer side wall 108 of the turbine nozzle 100. For example, the inserts may direct the compressed air 38 onto the corresponding forward cavity wall 146 or aft cavity wall 148 to, e.g., facilitate impingement cooling. Any portion of the compressed air 38 flowing through the cavities 140, 142 or the inserts positioned therein will hereinafter be referred to as cooling air.

Referring now to FIGS. 3 and 4, the turbine nozzle 100 may define one or more cooling passages 150 therein. The cooling passages 150 supply cooling air from the cavities 140, 142 to the radially outer surface 108 of the inner side wall 102 and/or the radially inner surface 112 of the outer side wall 104. In this respect, the cooling passages 150 are defined by the inner and/or outer side walls 102, 104. More specifically, the cooling passages 150 are fluidly coupled to one of the cavities 140, 142. Each cooling passage 150 extends from the corresponding cavity 140, 142 to the corresponding radially outer surface 108 of the inner side wall 102 or the radially inner surface 112 of the outer side wall 104. The cooling passages 150 may be oriented at an acute or obtuse angle relative to the corresponding radially outer surface 108 of the inner side wall 102 or the radially inner surface 112 of the outer side wall 104. This permits the cooling air exiting the cooling passages 150 to flow along the radially outer surface 108 of the inner side wall 102 or the radially inner surface 112 of the outer side wall 104, thereby providing film cooling. The cooling passages 150 may also be oriented such that cooling air exiting the cooling passages 150 is flowing in the same direction as combustion gases 40 flowing through the turbine nozzle 100.

Referring particularly to FIG. 4, the turbine nozzle 100 includes one or more cooling passages 152, which have the same function as the cooling passages 150. The geometry of the turbine nozzle 100, however, may make it difficult to form the cooling passages 152. In certain areas of the inner or outer side walls 102, 104, for example, it may be impossible to drill a passage (i.e., the cooling passage 152) oriented in the direction of the flow of the combustion gases 40 that also intersects the one of the cavities 140, 142. In the embodiment shown in FIG. 4, two cooling passages 152 are defined by the outer side wall 104 and, more particularly, by a suction side of the outer side wall 104. In alternate embodiments, however, the turbine nozzle 100 may define more or less cooling passages 152 and the cooling passages 152 may be defined by a pressure side of the outer side wall 104 or the inner side wall 102.

Figure 5:
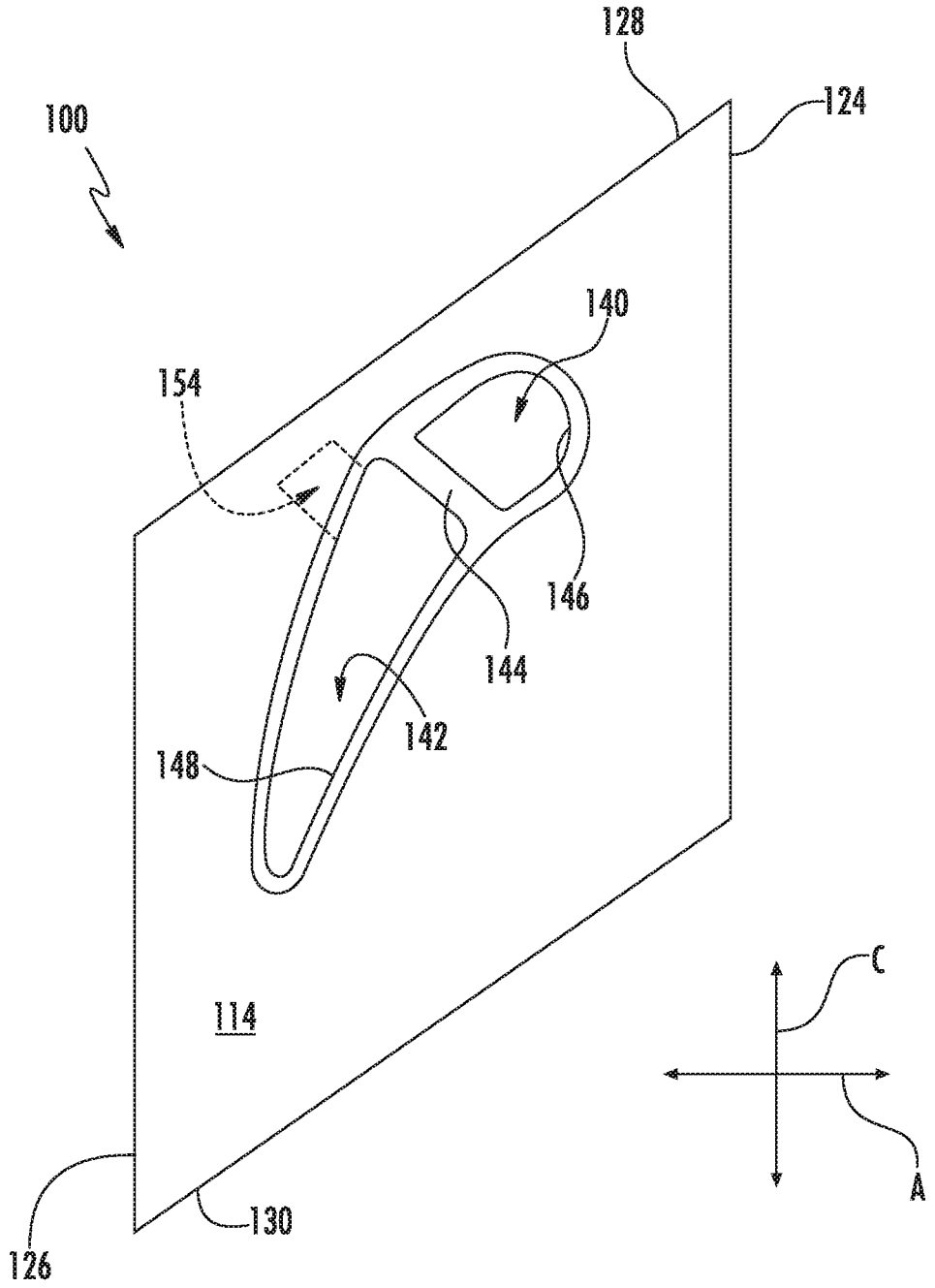
FIG. 5 is a top view of the turbine nozzle shown in FIG. 3, illustrating the location of a pocket.

As illustrated in FIGS. 3 and 5, the turbine nozzle 100 defines a pocket 154 therein. In particular, the pocket 154 extends outward from one of the cavities 140, 142. As such, each cooling passage 152 may be formed in the direction of the flow of the combustion gases 40 and intersect the pocket 154. In the embodiment shown in FIGS. 3 and 5, the turbine nozzle 100 defines one pocket 154. In alternate embodiments, however, the turbine nozzle 100 may define two pockets 154, three pockets 154, or more pockets 154.

Referring particularly to FIG. 5, the cavity wall 148 at least partially defines the pocket 154. In the embodiment shown in FIG. 5, the outer side wall 104 may also partially define the pocket 154. In particular, a suction side portion of the outer side wall 104 may partially define the pocket 154. In alternate embodiments, a pressure side portion of the outer side wall 104 may partially define the pocket 154. In further embodiments, the inner side wall 102 may partially define the pocket 154.

As mentioned above, the pocket 154 extends outward from one of the cavities 140, 142. In particular, the pocket 154 may extend axially and/or circumferentially outward from one of the cavities 140, 142. As such, the pocket 154 is fluidly coupled to one of the cavities 140, 142. In the embodiment shown in FIGS. 3 and 4, the pocket 154 extends axially and circumferentially outward from the aft cavity 142. Specifically, the pocket 154 may extend axially and circumferentially outward from an axially forward half of the aft cavity 142. Accordingly, the pocket 154 is fluidly coupled to the aft cavity 142 in the embodiment shown in FIGS. 3 and 4. In this respect, the aft cavity wall 148 defines a pocket inlet 156 (FIG. 7) of the pocket 154. In alternate embodiments, the pocket 154 may extend outward from and be fluidly coupled to forward cavity 140 or any other cavity defined by the turbine nozzle 100.

Figure 6:
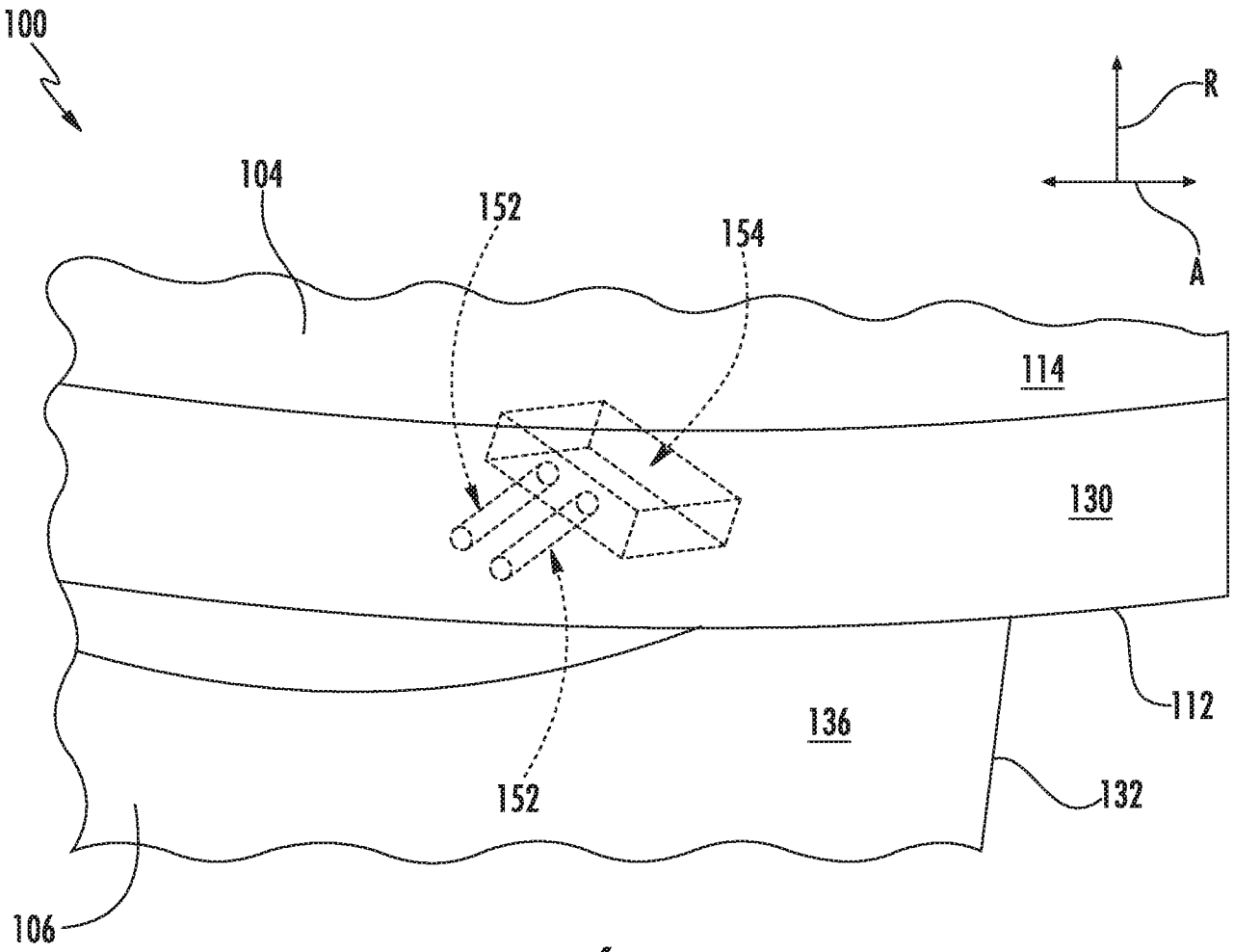
FIG. 6 is an enlarged perspective view of a portion of the turbine nozzle shown in FIGS. 3 and 4, illustrating at least some of the cooling passages being fluidly coupled to the pocket.
Figure 7:
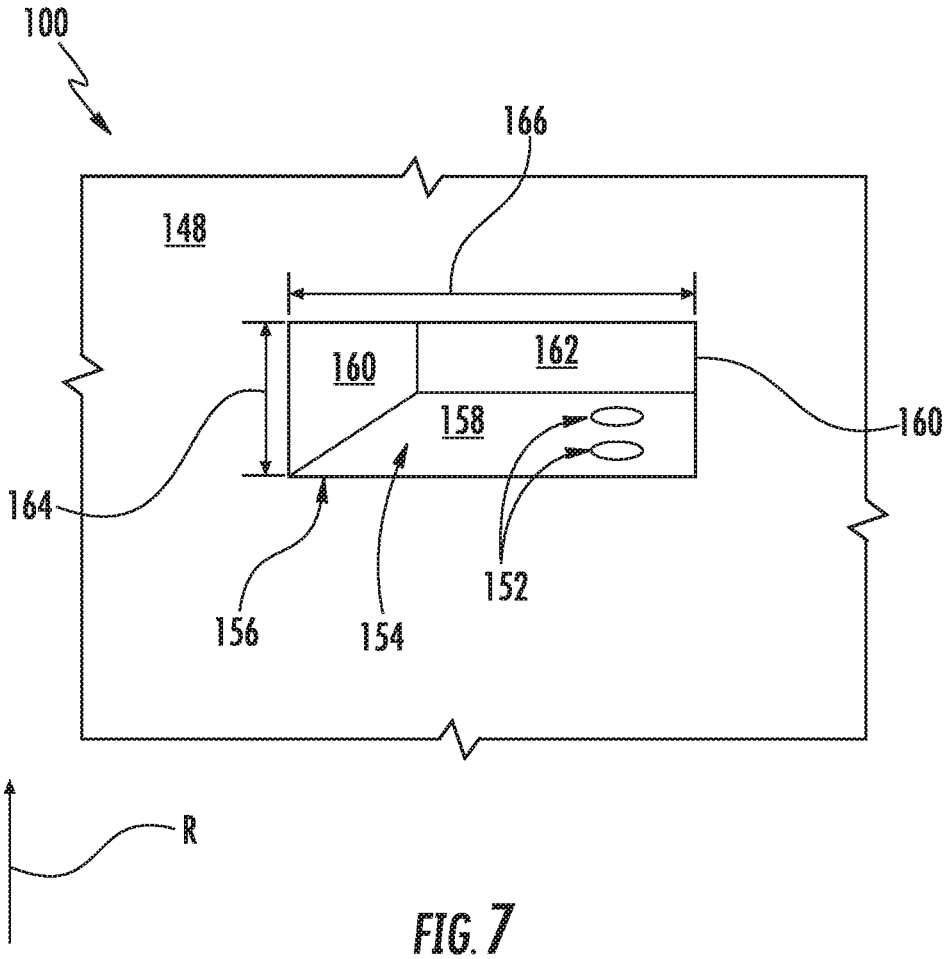
FIG. 7 is an enlarged front view of the pocket, illustrating a pocket inlet.

Referring now to FIGS. 6 and 7, one or more of the cooling passages 152 intersect the pocket 154 and are fluidly coupled to the pocket 154. In the embodiment shown in FIG. 6, two cooling passages 152 intersect a bottom surface 158 of the pocket 154. As shown in FIG. 6, the cooling passages 152 extend axially and radially from the pocket 154 to the radially inner surface 112 of the outer side wall 104. In alternate embodiments, more or fewer cooling passages 152 may intersect the pocket 154 and the cooling passage 152 may intersect other surfaces (e.g., a side surface 160, a rear surface 162, etc.) of the pocket 154.

The pocket 154 may be closed except for the pocket inlet 156 and the cooling passages 152 that intersect the pocket 154. In this respect, the pocket 154 may not include any outlets other than the cooling passages 152.

FIG. 7 illustrates one embodiment of a cross-sectional shape of the pocket 154. As shown, the pocket 154 may have a rectangular cross-section. In this respect, the pocket 154 may have a pocket height 164 and a pocket width 166. The pocket height 164 extends in the radial direction R, while the pocket width 166 extends in the axial and/or circumferential directions A, C. In certain embodiments, the pocket width 166 may be greater than the pocket height 164. This configuration may be necessary to provide sufficient cooling air to the cooling passages 152 in embodiments where the inner or outer side walls 102, 104 are relatively narrow. Furthermore, a cross-sectional area of the pocket 154 may be larger than a cross-sectional area of the each of the cooling passages 152 fluidly coupled to the pocket 154. In such embodiments, the pocket 154 acts as a plenum to supply cooling air to the cooling passages 152. In alternate embodiments, the pocket 154 may have any suitable cross-sectional shape or configuration.

The pocket 154 may be formed in the turbine nozzle 100 using any suitable method. For example, the pocket 154 may be formed during the casting process of the pocket 154. Alternately, the pocket 154 may be formed in the turbine nozzle 100 after casting via conventional machining (e.g., with an end mill), electrical discharge machining, or any other suitable material removal process. Formation of the pocket 154 may not require the addition of material (e.g., plugging or closing a portion of the pocket 154) upon completion of the material removal process.

In operation, the pocket 154 provides cooling air to the cooling passages 152. As mentioned above, a portion of the compressed air 38 may be bled from the compressor section 12 (FIG. 1) and directed into the turbine nozzle 100. In particular, this cooling air may flow radially inward through the cavities 140, 142 or any inserts (not shown) positioned therein. A portion of the cooling air in one of the cavities 140, 142 flows into the pocket 154. If the turbine nozzle 100 includes inserts, the cooling air may flow through the insert before flowing into one of the cavities 140, 142 and the pocket 154. The cooling air then flows into the cooling passages 152 fluidly coupled to the pocket 154. The cooling air exits the cooling passages 152 and the turbine nozzle 100 before flowing along the radially outer surface 108 of the inner side wall 102 or the radially inner surface 112 of the outer side wall 104. In this respect, the pocket 154 and the cooling passages 152 fluidly coupled thereto facilitate film cooling of the radially outer surface 108 of the inner side wall 102 or the radially inner surface 112 of the outer side wall 104.

The cooling passages 152 may not intersect one of the cavities 140, 142 if oriented such that the cooling air exits the cooling passages 152 in the same direction that combustion gases 40 flow through the turbine nozzle 100. As discussed in greater detail above, the pocket 154 extends outward from and fluidly couples to one of the cavities 140, 142. In this respect, the cooling passages 152 may intersect the pocket 154 and still be oriented such that the cooling air exits in the same direction that the combustion gases 40 flow. As such, the turbine nozzle 100 requires less cooling air to provide sufficient film cooling to the radially outer surface 108 of the inner side wall 102 or the radially inner surface 112 of the outer side wall 104 than conventional turbine nozzles. Accordingly, the turbine nozzle 100 diverts less compressed air 38 from the compressor section 12 (FIG. 1) than conventional turbine nozzles, thereby increasing the efficiency of the gas turbine engine 10.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A nozzle for a turbomachine, the nozzle comprising:
an inner side wall;
an outer side wall radially spaced apart from the inner side wall;
an airfoil extending radially from the inner side wall to the outer side wall, the airfoil defining a cavity that extends radially through the nozzle, the cavity being at least partially defined by a cavity wall;
a pocket defining a plenum in fluid communication with the cavity, the pocket comprising a pocket inlet defined in the cavity wall, a rear surface opposite the pocket inlet, and a bottom surface, a top surface, and a pair of side walls extending between the pocket inlet and the rear surface, the pocket being defined by the cavity wall and one of the inner side wall or the outer side wall; and
a cooling passage defined by the one of the inner side wall or the outer side wall defining the pocket, wherein the cooling passage intersects the pocket at a cooling passage inlet, the cooling passage inlet being in fluid communication with the cavity via the plenum defined by the pocket and a cooling passage outlet in a surface of the one of the inner side wall or the outer side wall defining the pocket, the surface being a radially outer surface of the inner side wall or a radially inner surface of the outer side wall.

2. The nozzle of claim 1, wherein the outer side wall partially defines the pocket.

3. The nozzle of claim 2, wherein a suction side portion of the outer side wall partially defines the pocket.

4. The nozzle of claim 2, wherein the cooling passage extends radially and axially from the pocket to the radially inner surface of the outer side wall.

5. The nozzle of claim 1, wherein cooling air exiting the cooling passage is flowing in the same direction as combustion gases flowing through the nozzle.

6. The nozzle of claim 1, wherein the pocket has a larger cross-sectional area than the cooling passage.

7. The nozzle of claim 1, wherein the nozzle defines a plurality of cooling passages fluidly coupled to the pocket.

8. The nozzle of claim 1, wherein the cavity comprises a forward cavity and an aft cavity, and wherein the pocket is in fluid communication with the aft cavity.

9. A gas turbine engine comprising:
a compressor section;
a combustion section; and
a turbine section comprising a plurality of nozzles, each nozzle comprising:
an inner side wall;
an outer side wall radially spaced apart from the inner side wall;
an airfoil extending radially from the inner side wall to the outer side wall, the airfoil defining a cavity that extends radially through the nozzle, the cavity being at least partially defined by a cavity wall;
a pocket defining a plenum in fluid communication with the cavity, the pocket comprising a pocket inlet defined in the cavity wall, a rear surface opposite the pocket inlet, and a bottom surface, a top surface, and a pair of side walls extending between the pocket inlet and the rear surface, the pocket being defined by the cavity wall and one of the inner side wall or the outer side wall; and
a cooling passage defined by the one of the inner side wall or the outer side wall defining the pocket, wherein the cooling passage intersects the pocket at a cooling passage inlet, the cooling passage inlet being in fluid communication with the cavity via the plenum defined by the pocket and a cooling passage outlet in a surface of the one of the inner side wall or the outer side wall defining the pocket, the surface being a radially outer surface of the inner side wall or a radially inner surface of the outer side wall.

10. The gas turbine engine of claim 9, wherein the outer side wall partially defines the pocket.

11. The gas turbine engine of claim 10, wherein a suction side portion of the outer side wall partially defines the pocket.

12. The gas turbine engine of claim 10, wherein the cooling passage extends radially and axially from the pocket to the radially inner surface of the outer side wall.

13. The gas turbine engine of claim 9, wherein cooling air exiting the cooling passage is flowing in the same direction as combustion gases flowing through the nozzle.

14. The gas turbine engine of claim 9, wherein the pocket has a larger cross-sectional area than the cooling passage.

15. The gas turbine engine of claim 9, wherein the nozzle defines a plurality of cooling passages fluidly coupled to the pocket.

16. The gas turbine engine of claim 9, wherein the cavity comprises a forward cavity and an aft cavity, and wherein the pocket is in fluid communication with the aft cavity.

* * * * *